US008141196B2

(12) United States Patent
Chen

(10) Patent No.: US 8,141,196 B2
(45) Date of Patent: Mar. 27, 2012

(54) CLEAN DEVICE WITH DECORATING STRIP

(76) Inventor: Ming-Hsin Chen, Changhua County (TW)

( * ) Notice: Subject to any disclaimer, the term of this patent is extended or adjusted under 35 U.S.C. 154(b) by 493 days.

(21) Appl. No.: 12/411,341

(22) Filed: Mar. 25, 2009

(65) Prior Publication Data

US 2010/0242197 A1 Sep. 30, 2010

(51) Int. Cl.
*A47K 7/02* (2006.01)

(52) U.S. Cl. ..... 15/209.1; 15/223; 15/229.11; 428/4

(58) Field of Classification Search ..... 15/209.1, 15/223, 229.11, 229.12; 428/4, 5
See application file for complete search history.

(56) References Cited

U.S. PATENT DOCUMENTS 7,144,088 B2 * 12/2006 Chang ..... 300/21
2005/0034258 A1 * 2/2005 Huang ..... 15/209.1

FOREIGN PATENT DOCUMENTS

EP 896810 * 2/1999

* cited by examiner

*Primary Examiner* — Mark Spisich

(57) ABSTRACT

A clean device with decorating strip includes a belt and at least one decorating strip received in the belt. The belt is composed of elastic nets and has a hollow oblong shaped structure. At least one decorating strip is inserted into the hollow structure of the belt and received in the belt. A lateral side of the belt including the at least one decorating strip are reiteratively overlapped to form a folded structure having multiple layers formed on two ends of the folded structure. A fastening means is tightened a middle section of the folded structure.

5 Claims, 7 Drawing Sheets

CLEAN DEVICE WITH DECORATING STRIP

BACKGROUND OF THE INVENTION

1. Field of the Invention

The present invention relates to a clean device, and more particularly to a clean device with decorating strip.

2. Description of Related Art

There are many kinds of body cleansing products already existed in the markets, including liquid soap, perfumed soap, etc. There are also different types of conventional cleaning devices, such as back brush, bath scrubber, bath ball, bath sponge, etc., suitable for working with the cleansing products to clean a user's body.

A conventional clean device has a ball structure formed from multiple layers of superposed elastic net woven out of artificial fibers. The elastic nets are axially compressed to produce a corrugated ring. The corrugated ring is tightened at two diametrically opposite points with fastening means such that outer peripheries of the corrugated ring are widely spread to form a loosely ruffled spherical body. The multiple layers of elastic nets are overlapped to form numerous small spaces for producing bubbles.

However, the conventional clean device is formed by limited numbers of layers and the elastic net is formed with one single color. With the limited numbers of layers, the conventional clean device has a poor ability for cleaning the body and producing bubbles. The user might need to use the clean device many times. Furthermore, the monotonous color of the conventional clean device lacks attraction for consumers and might not be suitable to be a bathroom decor.

The present invention has arisen to mitigate and/or obviate the disadvantages of the conventional clean device.

SUMMARY OF THE INVENTION

The main objective of the present invention is to provide an improved clean device having at least one decorating strip inserted into the clean device.

To achieve the objective, a clean device with decorating strip in accordance with the present invention comprises a belt and at least one decorating strip received in the belt. The belt is composed of elastic nets and has a hollow oblong shaped structure. At least one decorating strip is inserted into the hollow structure of the belt and received in the belt. A lateral side of the belt including the at least one decorating strip are reiteratively overlapped to form a folded structure having multiple layers formed on two ends of the folded structure. A fastening means is tightened a middle section of the folded structure with a fastening means. The decorating strip can be a colored belt, a string of beads, or a colored belt assembly including multiple colored belts.

The belt is composed of the elastic nets having multiple meshes for guiding air into the belt. The decorating strip is movably disposed in the hollow structure of the belt for stirring soap liquid. When the clean device is soaked in soap liquid and scrubbed, the multiple meshes and the decorating strip are easily mixed air and soap liquid to foam numerous bubbles. The color of the decorating strip is different from that of the belt such that the clean device has a colorful and visually pleasant design.

Further benefits and advantages of the present invention will become apparent after a careful reading of the detailed description with appropriate reference to the accompanying drawings.

DETAILED DESCRIPTION OF THE INVENTION

Figure 1:
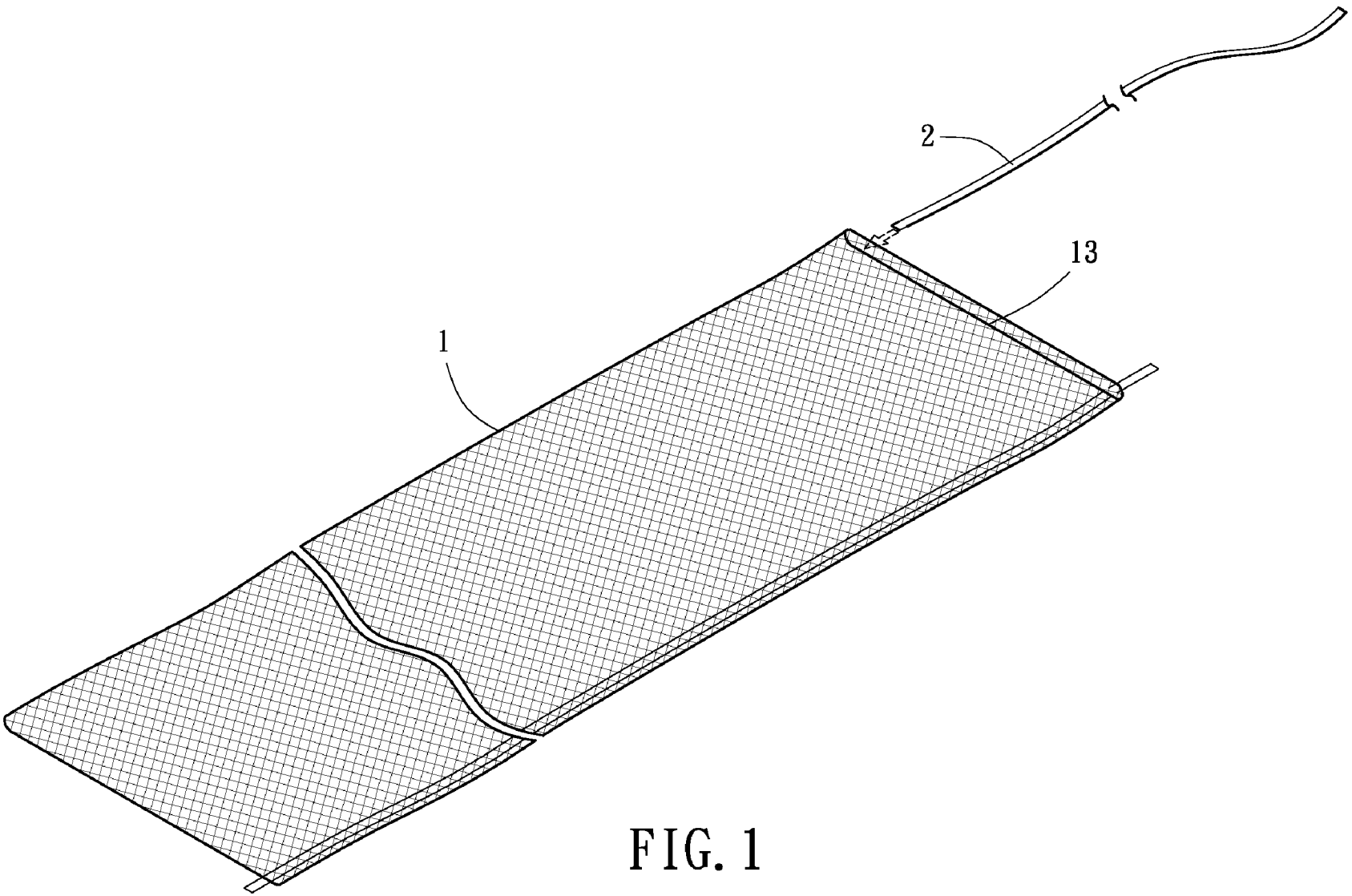
FIG. 1 is an exploded perspective view of a clean device with decorating strip in accordance with the present invention.
Figure 2:
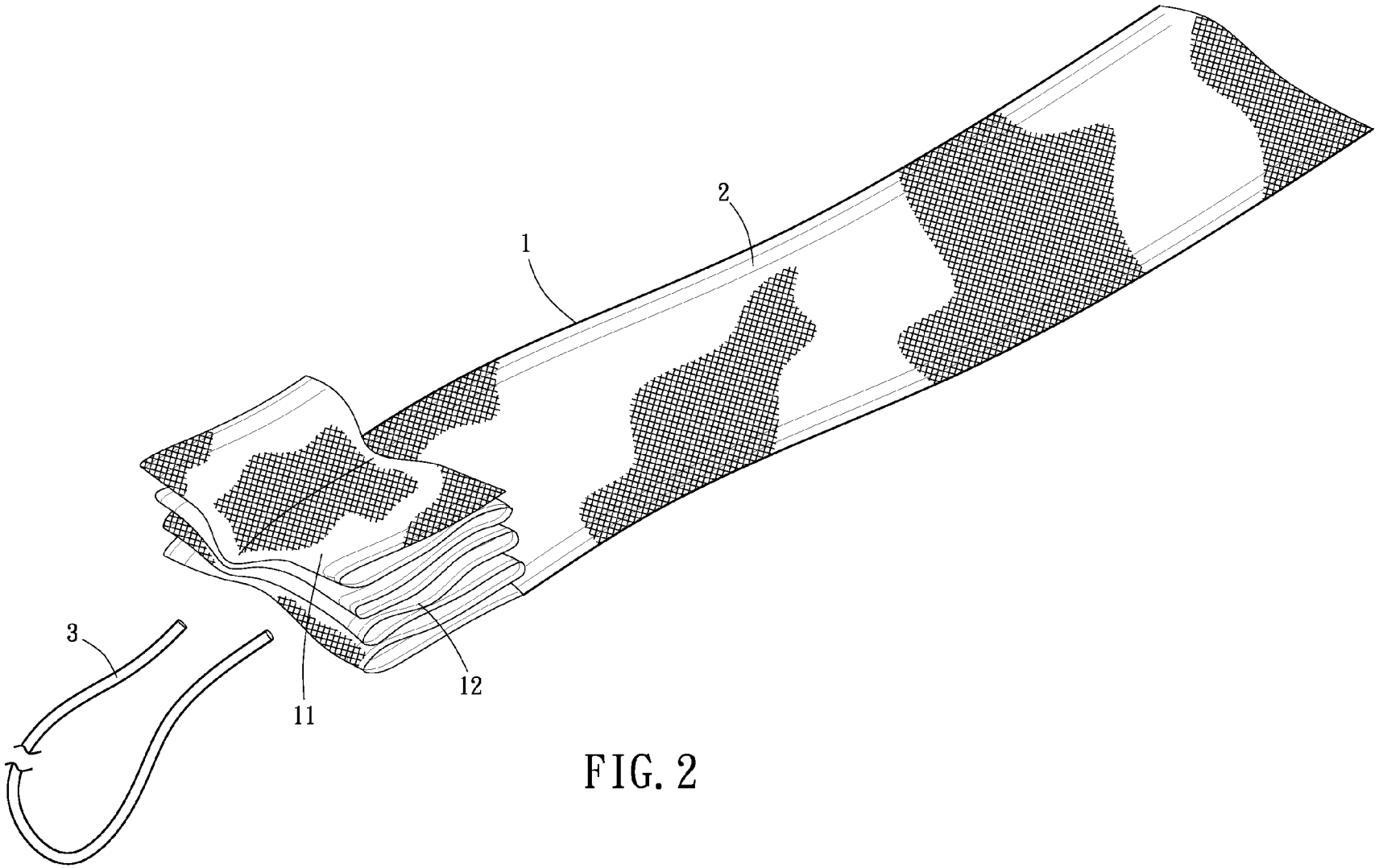
FIGS. 2-3 are assembled perspective views of a clean device with decorating strip in accordance with the present invention.
Figure 3:
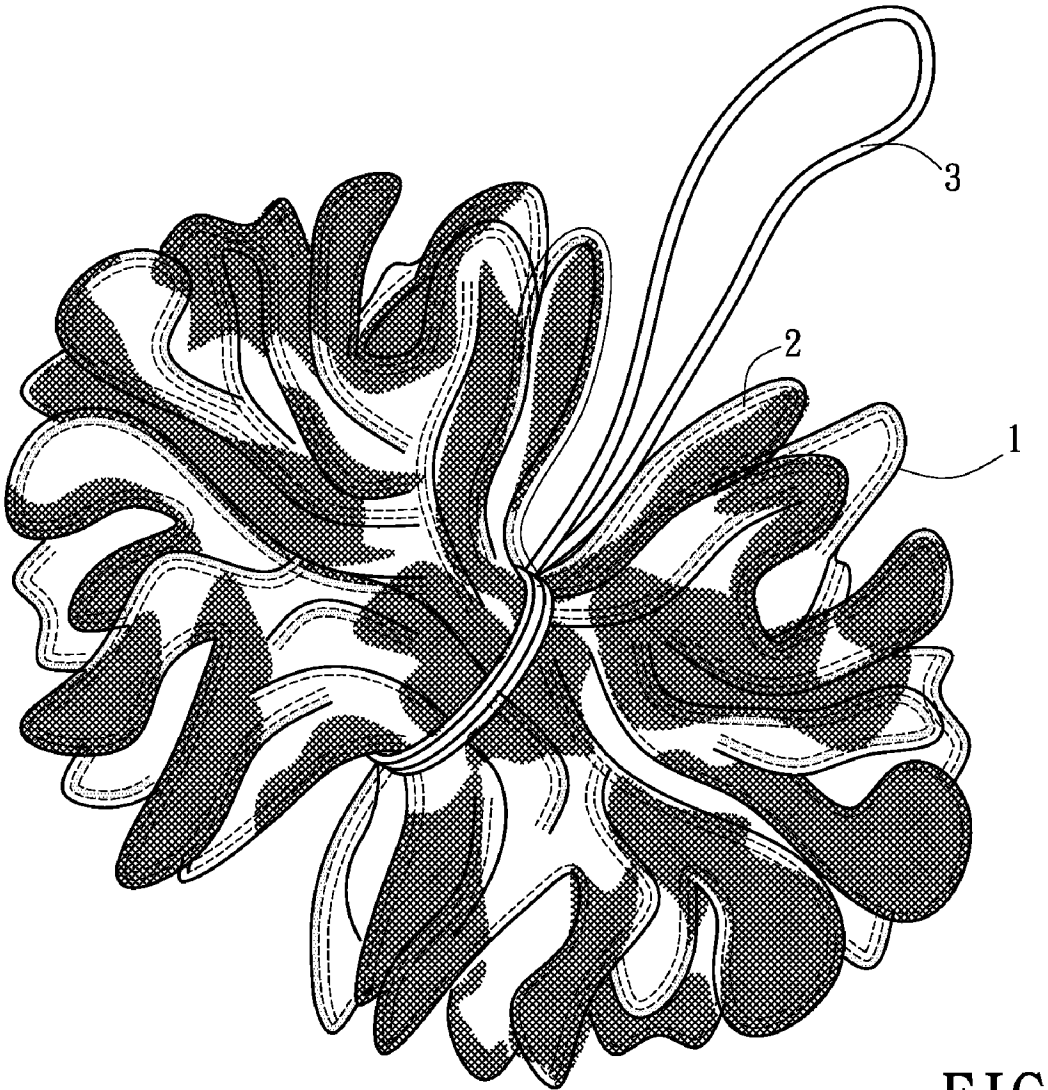
Figure 4:
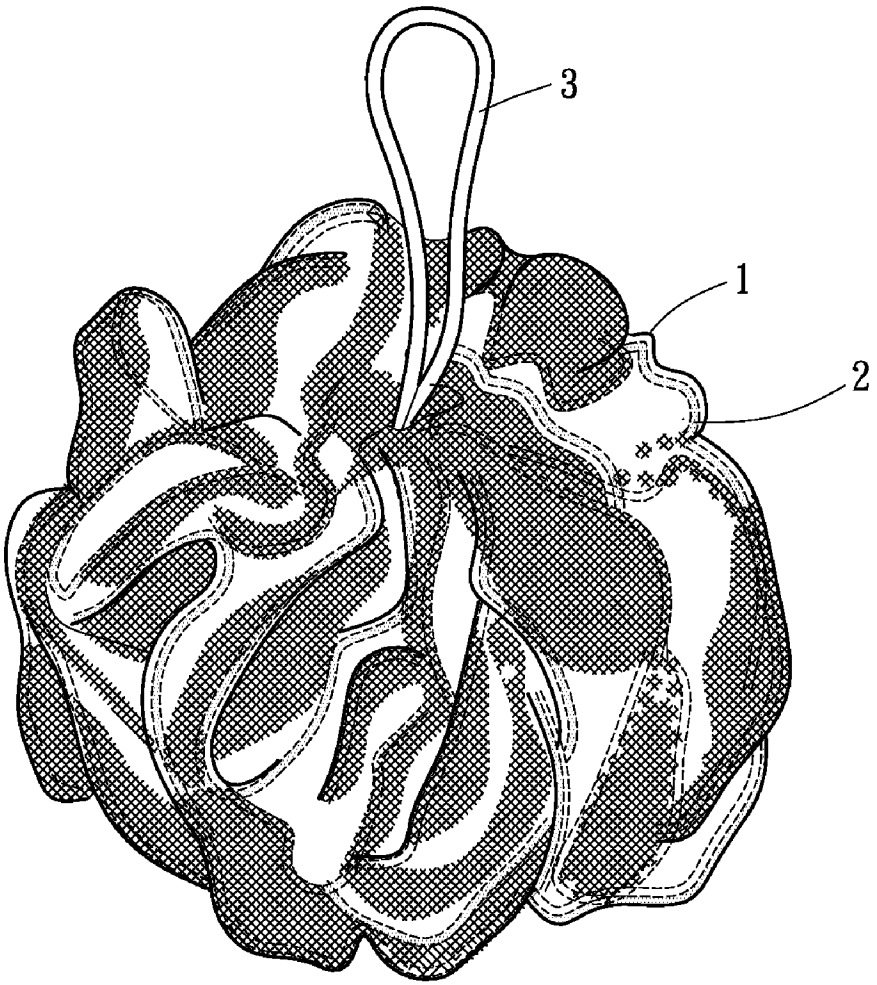
FIG. 4 is a perspective view of a clean device with decorating strip in accordance with the present invention.

Referring to the drawings and initially to FIGS. 1-4, a first embodiment of a clean device with decorating strip in accordance with the present invention comprises a belt 1 and at least one decorating strip 2 received in the belt 1.

The belt 1 is composed of elastic nets and has a hollow rectangle shaped structure.

The at least one decorating strip 2 is inserted into the hollow structure 13 of the belt 1. The as least one decorating strip 2 is unfixedly and movably received in the hollow structure 13 of the belt 1. In the preferred embodiment of the present invention, two decorating strips 2 are unfixedly and movable received in the hollow structure 13 of the belt 1. The two decorating strips 2 are respectively disposed in two lateral sides of the hollow structure 13. Each of the two decorating strips 2 is a colored belt 2. Each colored belt has a color differing from that of the belt 1. The color of each decorating strip 2 can be different from each other. The lateral side of the belt 1 including the two decorating strips 2 is reiteratively overlapped to form a folded structure 11. The folded structure 11 has multiple layers 12 formed on two ends of the folded structure 11.

For keeping the belt 1 including the two decorating strips 2 in the form of the folded structure 11, a string 3 is used to tighten a middle section of the folded structure 11. The string 3 can be any fastening means or the like, such as an elastic band, or a hoop. The multiple layers 12 formed on two ends of the folded structure 11 are widely spread and loosely ruffled. In the preferred embodiment of the present invention, the multiple layers 12 formed on two ends of the folded structure 11 are widely spread and loosely ruffled to form a ball structure provided for foaming numerous bubbles. The decorating strip 2 disposed in each of the multiple layers 12 is reiteratively overlapped to form a complex obviously decorative design.

The belt 1 is composed of the elastic nets having multiple meshes for guiding air into the belt. The decorating strip 2 is movably disposed in the hollow structure 13 of the belt 1 for stirring soap liquid. When the clean device in accordance with the present invention is soaked in soap liquid and scrubbed, the multiple meshes and the decorating strip 2 are easily mixed air and soap liquid to foam numerous bubbles. The color of the decorating strip 2 is different from that of the belt 1 such that the clean device in accordance with the present invention has a colorful and visually pleasant design.

Figure 5:
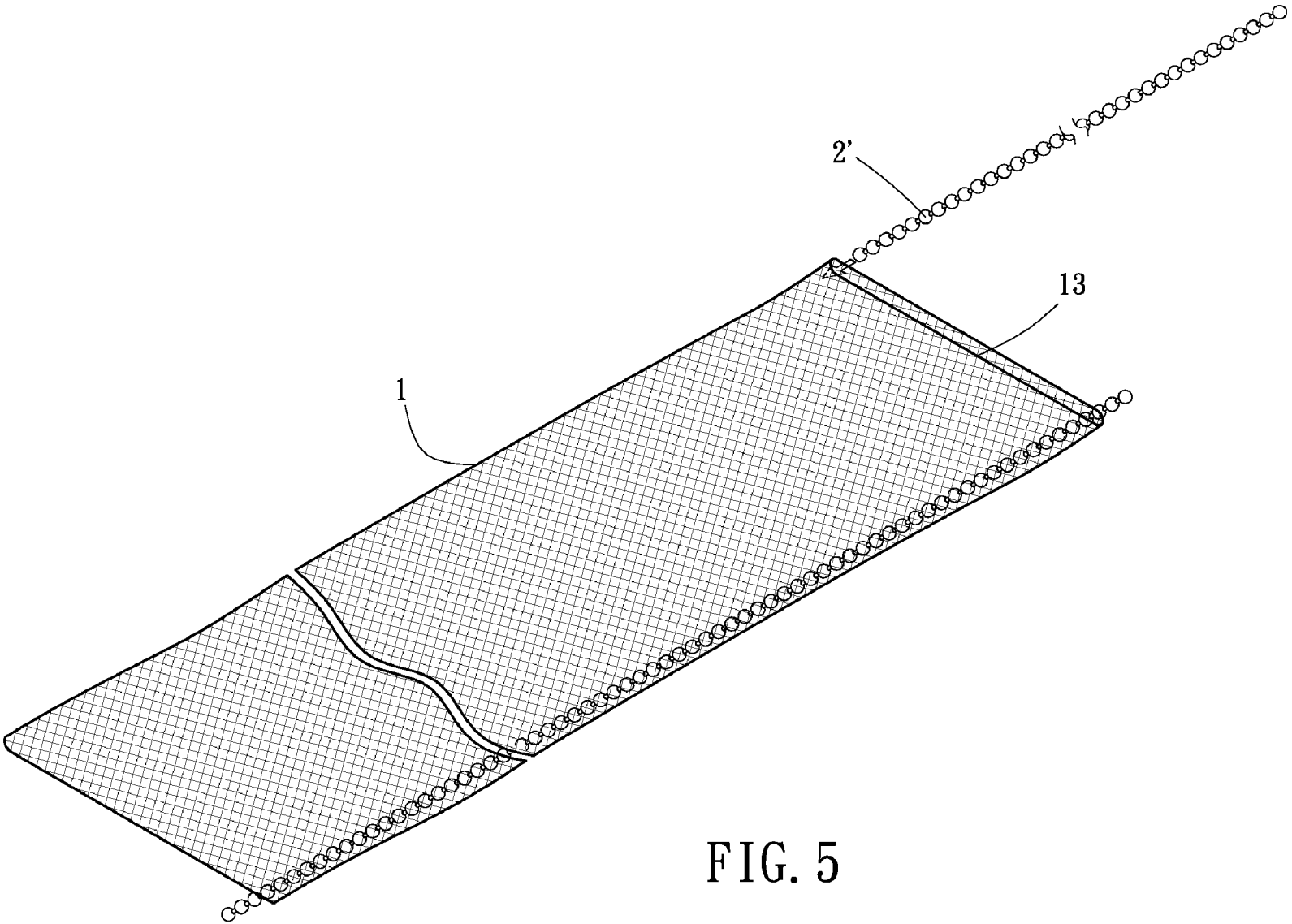
FIG. 5 is an exploded perspective view of a second embodiment of a clean device with decorating strip in accordance with the present invention.
Figure 6:
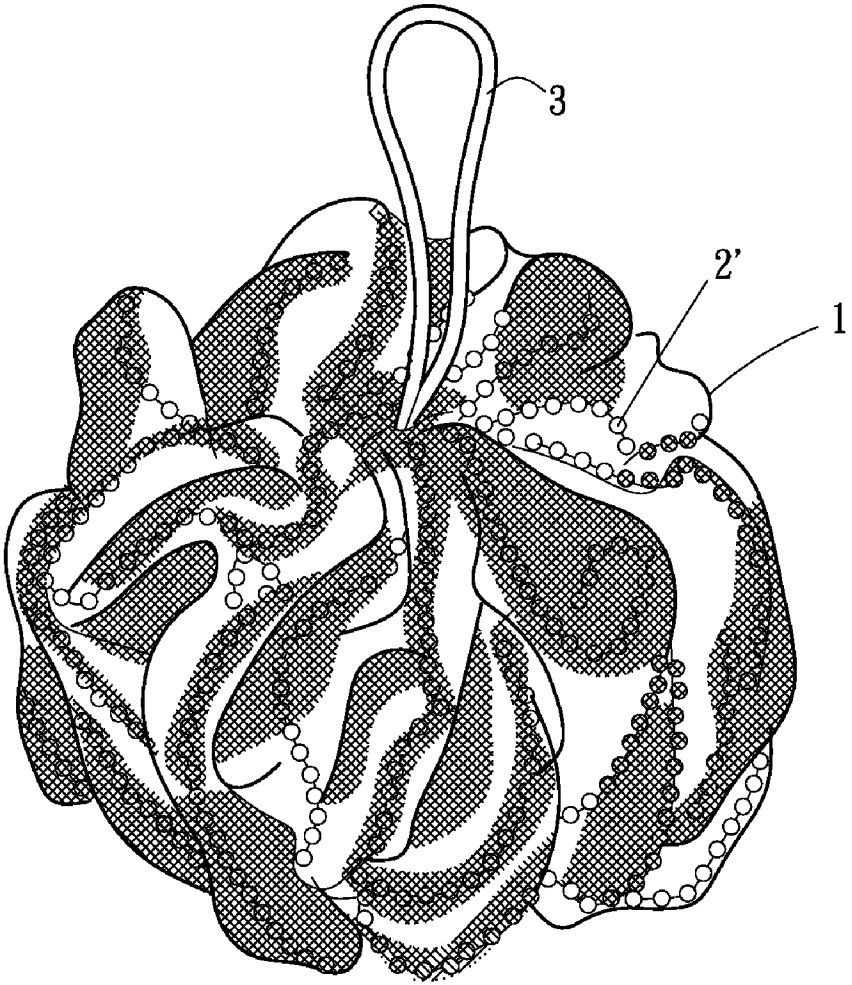
FIG. 6 is a perspective view of the second embodiment of the clean device with decorating strip in accordance with the present invention.

With reference to FIGS. 5-6, that shows a second embodiment of the clean device with decorating strip in accordance with the present invention. The elements and effects of the third embodiment which are the same with the first embodiment are not described, only the differences are described. Each of the at least one decorating strip 2 is a string of beads 2' having an obviously decorative effect differing from the belt 1. The string of beads 2' is movably disposed in the hollow structure 13 of the belt 1 for stirring soap liquid for foaming numerous bubbles.

Figure 7:
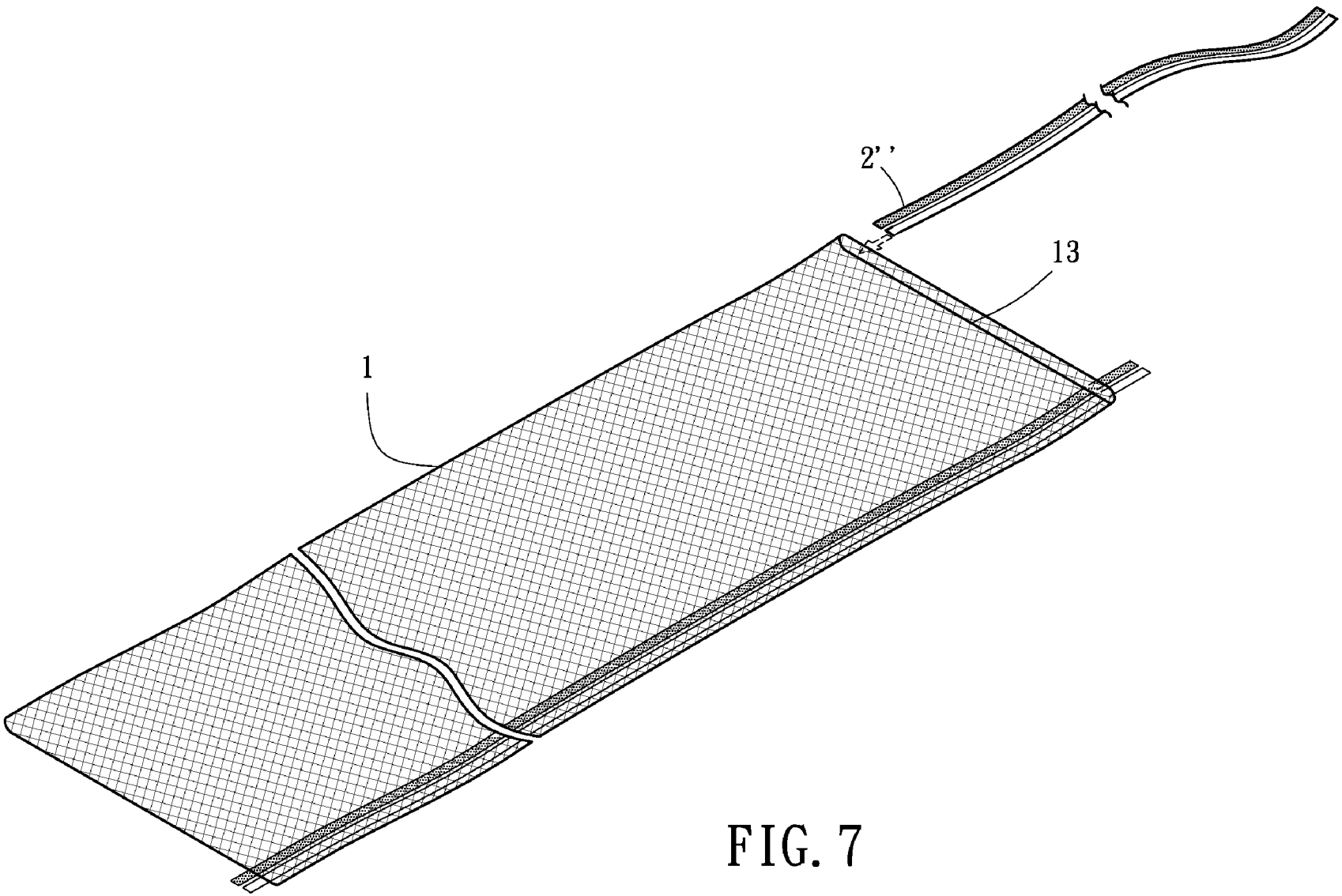
FIG. 7 is an exploded perspective view of a third embodiment of a clean device with decorating strip in accordance with the present invention.

With reference to FIG. 7, that shows a third embodiment of the clean device with decorating strip in accordance with the present invention. The elements and effects of the third embodiment which are the same with the first embodiment are not described, only the differences are described. Each of the at least one decorating strip 2 is a colored belt assembly 2" including multiple colored belts. Each of the multiple colored belts has a color differing from each other for providing an obviously decorative effect. In the preferred embodiment of the present invention, the colors of the multiple colored belts are different from the color of the belt 1. The multiple colored belts are movably disposed in the hollow structure 13 of the belt 1 for stirring soap liquid for foaming numerous bubbles.

Although the invention has been explained in relation to its preferred embodiment, it is to be understood that many other possible modifications and variations can be made without departing from the spirit and scope of the invention as hereinafter claimed.

What is claimed is:

1. A clean device with decorating strip comprising:

a belt composed of elastic nets and having a hollow rectangle shaped structure;

at least one decorating strip inserted into the hollow structure of the belt and received in the belt, the at least one strip disposed in a lateral side of the hollow structure, the lateral side of the belt including the at least one decorating strip reiteratively overlapped to form a folded structure having multiple layers formed on two ends of the folded structure; and a fastening means tightened a middle section of the folded structure;

wherein multiple layers formed on two ends of the folded structure are widely spread and loosely ruffled such that the folded structure is provided for foaming numerous bubbles, the decorating strip received in the belt reiteratively overlapped to form a complex decorative design.

2. The clean device with decorating strip as claimed in claim 1, wherein two decorating strips are inserted into the hollow structure of the belt and received in a the belt, the two decorating strips respectively disposed in two lateral sides of the hollow structure, the lateral sides of the belt including the two decorating strips reiteratively overlapped to form a folded structure having multiple layers formed on two ends of the folded structure, the decorating strips disposed in each of the multiple layers for providing a obviously decorative effect and foaming numerous bubbles.

3. The clean device with decorating strip as claimed in claim 1, wherein each of the at least one decorating strip is a colored belt having a color differing from a color of the belt.

4. The clean device with decorating strip as claimed in claim 1, wherein each of the at least one decorating strip is a string of beads for providing an obviously decorative effect and foaming numerous bubbles.

5. The clean device with decorating strip as claimed in claim 1, wherein each of the at least one decorating strip is a colored belt assembly including multiple colored belts, each of the multiple colored belts having a color differing from each other for providing an obviously decorative effect and foaming numerous bubbles.

* * * * *